United States Patent [19]

Minohara et al.

[11] Patent Number: 4,884,522

[45] Date of Patent: Dec. 5, 1989

[54] TANK STABILIZER

[75] Inventors: Kiyomi Minohara; Satoshi Sogabe, both of Takarazuka; Shinichiro Suzuki, Takatsuki, all of Japan

[73] Assignee: Furuno Electric Company Limited, Hyogo, Japan

[21] Appl. No.: 197,022

[22] Filed: May 20, 1988

[30] Foreign Application Priority Data

May 20, 1987 [JP] Japan ..... 62-75390

[51] Int. Cl.[4] ..... B63B 39/03

[52] U.S. Cl. ..... 114/125

[58] Field of Search ..... 114/122, 125

[56] References Cited

U.S. PATENT DOCUMENTS

| | | | |
|---|---|---|---|
| 132,695 | 5/1943 | Hort | 114/125 |
| 1,023,477 | 4/1912 | Oldham | 114/125 |
| 3,422,782 | 1/1969 | Ripley | 114/125 |
| 3,487,801 | 1/1970 | Calvi | 114/125 |
| 3,774,567 | 11/1973 | Corvino et al. | 114/125 |

FOREIGN PATENT DOCUMENTS

| | | | |
|---|---|---|---|
| 2508748 | 9/1976 | Fed. Rep. of Germany | 114/125 |
| 11193 | 1/1982 | Japan | 114/125 |

*Primary Examiner*—Sherman D. Basinger

*Attorney, Agent, or Firm*—Birch, Stewart, Kolasch & Birch

[57] ABSTRACT

A passive tank stabilizer is mounted on a watergoing vessel in the athwartship direction for counteracting the roll of the vessel so that the vessel can be stabilized. The passive tank stabilizer comprises at least two tanks or two holders obtained by dividing one tank into two parts, with the tanks or the holders having different space volume and containing quantities of stabilizing liquid such as water. The passive tank stabilizer is capable of producing stabilizing effects over a wide range of roll frequencies of the vessel.

8 Claims, 7 Drawing Sheets

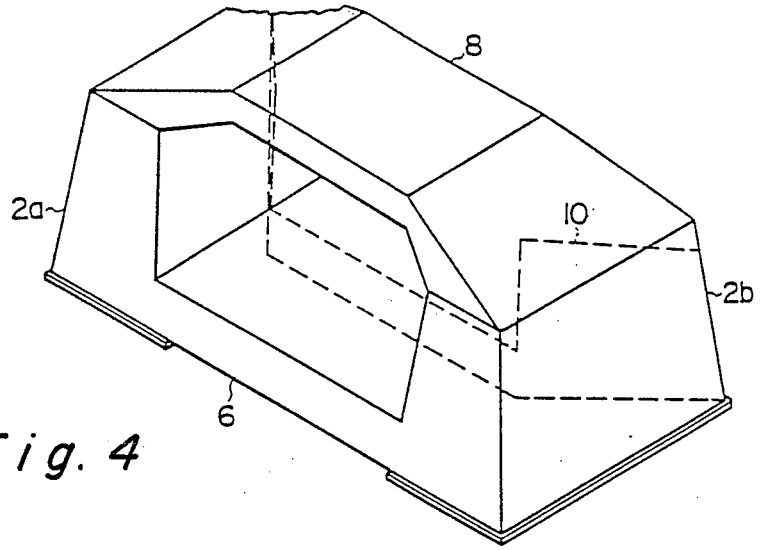
Fig. 4
Fig. 5
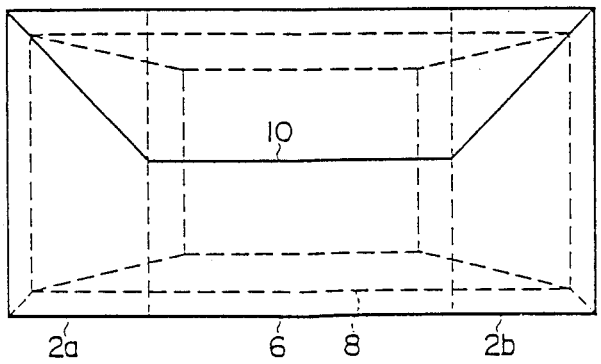

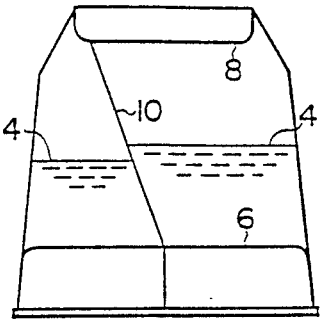
Fig. 6
Fig. 7
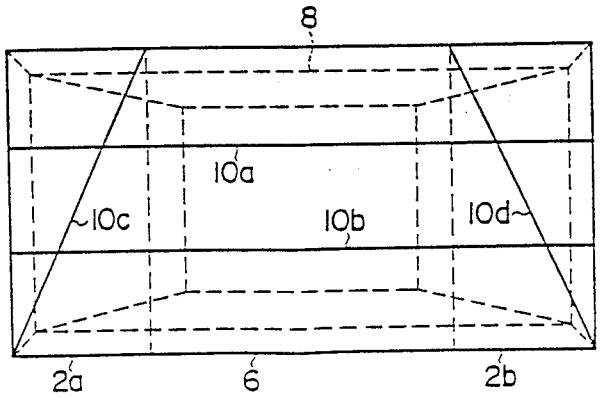

PRIOR ART

TANK STABILIZER

BACKGROUND OF THE INVENTION

The present invention relates to a passive tank stabilizer mounted on a watergoing vessel in the athwartship direction for counteracting the roll of the vessel so that the vessel can be stabilized. More particularly, the present invention relates to a passive tank stabilizer which comprises at least two tanks or two receptacles obtained by dividing one tank into two parts, which is adapted to hold quantities of stabilizing liquid such as water, and which is capable of producing stabilizing effects over a wide range of roll frequencies of the ship.

A prior art passive tank stabilizer is disclosed in a Japanese examined patent application publication No. 28873/1971, and is constructed as shown in FIGS. 13 through 15. The tank stabilizer employs a tank containing stabilizing liquid such as water, which is mounted on a ship in the athwartship direction. The tank comprises a left end chamber 2*a* and a right end chamber 2*b* connected at their lower ends by means of a crossover duct 6 and also connected at their upper ends by means of another crossover duct 8. The stabilizing tank if filled to a predetermined level with stabilizing liquid, above the level of the lower crossover duct. The crossover duct 6 is capable of transferring the stabilizing liquid, while the crossover duct 8 is capable of passing the air therethrough. The liquid in one end chamber is transferred to another chamber, which results in a rise or a fall of the liquid level in the end chambers depending on the roll of a ship. The natural frequency of the stabilizing liquid movement is set to be higher than the inherent roll frequency of the ship. The phase difference between the natural frequency of stabilizing liquid movement and the roll frequency of the ship causes the stabilizing liquid in the end chambers of the tank to counteract the roll of the ship so that stabilizing effects are produced. However, the prior art passive tank stabilizer is capable of producing stabilizing effects over roll frequencies of the ship only higher than or equal to the inherent roll frequency of the ship, but can not stabilize the ship over roll frequencies of the ship, which are lower than the inherent roll frequency of the ship.

SUMMARY OF THE INVENTION

Accordingly, an object of the present invention is to provide a passive tank stabilizer which is capable of producing stabilizing effects over a wide range of roll frequencies of a ship.

Another object of the present invention is to provide a passive tank stabilizer which comprises at least two tanks or two separate receptacles in one tank containing quantities of stabilizing liquid such as water, with the natural frequency of the stabilizing liquid movement in one tank or one receptacle being higher than the inherent roll frequency of the ship and the natural frequency of the stabilizing liquid in the other tank or the other receptacle being lower than the inherent roll frequency of the ship.

According to one aspect of the invention, the tank stabilizer comprises (i) a first tank comprising a pair of first end chambers and first crossover duct interconnecting the first end chambers near the lower portion thereof, (ii) a second tank comprising a pair of second end chambers near the lower portion thereof, which is different in space volume from that of the first tank and which is disposed in parallel with the first tank, and (iii) stabilizing liquid held in the first and second tank.

BRIEF DESCRIPTION OF THE DRAWING

The present invention will become more fully understood from the detailed description given hereinbelow and the accompanying drawings which are given by way of illustration only, and thus, are not limitative of the present invention, and wherein:

FIG. 4 shows a perspective view of another embodiment according to the present invention, FIG. 5 shows a top view of the embodiment depicted in FIG. 4, partially emphasized, FIG. 6 shows a sectional side view of another embodiment according to the present invention, FIG. 7 shows a top view of another embodiment according to the present invention, partially emphasized.

Throughout the drawings, the same reference numerals are given to like components.

DETAILED DESCRIPTION OF THE PREFERRED EMBODIMENTS

Figure 1A:
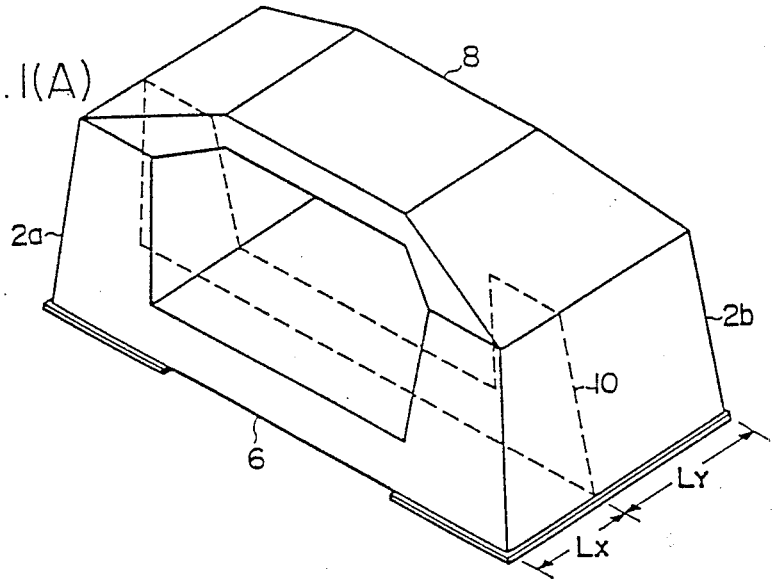
FIG. 1(A) shows a perspective view of one embodiment according to the present invention.
Figure 1B:
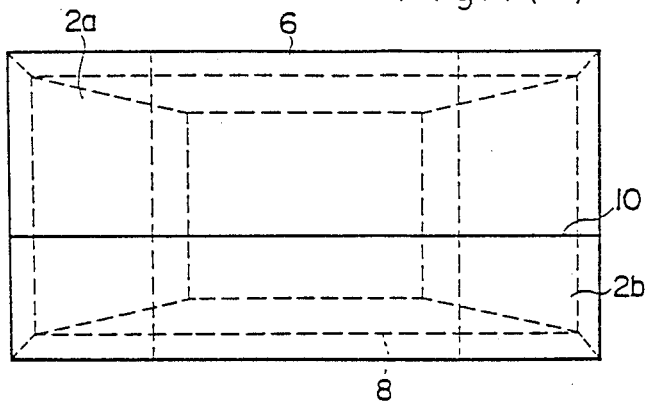
FIG. 1(B) shows a top view of the embodiment depicted in FIG. 1(A), partially emphasized.
Figure 1C:
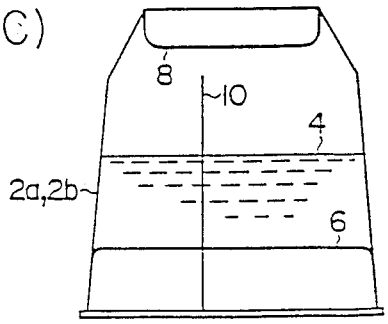
FIG. 1(C) shows a sectional side view of the embodiment shown in FIG. 1(A)

Referring to FIGS. 1(A) through 1(C), a tank stabilizer comprises a tank. The tank comprises a left end chamber 2*a* and a right end chamber 2*b* connected at their lower ends by means of a crossover duct 6 and also connected at their upper ends by means of another crossover duct 8, which may be hermetically sealed. The stabilizing tank is filled to a predetermined level with stabilizing liquid such as water, above the level of the lower crossover duct 6. The crossover duct 6 is capable of transferring the stabilizing liquid, while the duct 8 is capable of passing the air therethrough. The end chambers 2*a* and 2*b*, and the crossover duct 6 are divided into two parts by a vertical separation plate 10 with a division ratio Ly/Lx so that there are obtained two receptacles which are capable of holding stabilizing liquid. The division ratio Ly/Lx is determined in such a way that the natural frequency of the stabilizing liquid movement in one of the two resultant containers "Fx" is higher with respect to the inherent roll frequency "Fo" of the ship, and the natural frequency of the liquid movement in the other resultant container "Fy" is lower with respect to the inherent roll frequency "Fo" of the ship.

Figure 2:
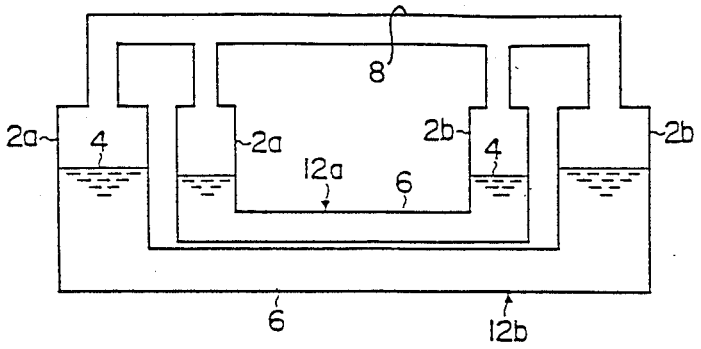
FIG. 2 shows a structure of another embodiment according to the present invention.

The tank stabilizer in the foregoing is equivalent to a tank stabilizer having two tanks disposed in parallel with each other, as shown in FIG. 2. This tank stabilizer comprises a U-type tank 12*a* having a shorter crossover duct connecting its end chambers 2*a* and 2*b* at the lower portions thereof, another U-type tank 12*b* having a longer crossover duct connecting its end chambers 2*a* and 2*b* at the lower portions thereof, and a common air duct 8 conecting the four end chambers at their upper ends. The U-type tank 12*a* having a shorter crossover duct has a higher natural frequency of the stabilizing liquid movement, and the U-type tank 12*b* having a longer crossover duct has a lower natural frequency of the liquid movement. A vessel equipped with both the stabilization tanks 12*a* and 12*b* is stabilized over a wide range of roll frequencies of a ship.

Figure 3:
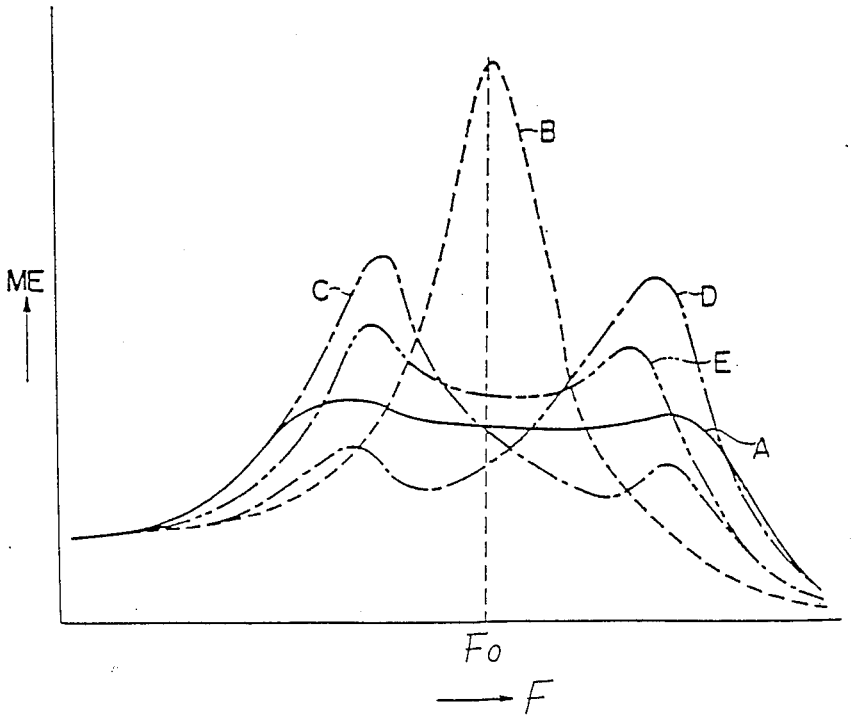
FIG. 3 shows characteristic diagrams for explaining the resultant stabilizing effects obtained by a tank stabilizer according to the present invention.

Referring to FIG. 3, a horizontal axis represents the roll frequency "F" of a ship, and a vertical axis represents roll energy "ME" of the ship. A curve "A" is obtained by mounting the tank stabilizer according to the present invention on the ship. A curve "B" is obtained with no tank stabilizers mounted on the ship. A curve "C" is obtained by mounting a tank stabilizer having a higher natural frequency of the stabilizing liquid movement with respect to the inherent roll frequency of the ship. A curve "D" is obtained by mounting a tank stabilizer having a lower natural frequency of the liquid movement with respect to the inherent roll frequency of the ship. A curve "E" is obtained by mounting a tank stabilizer having a natural frequency of the liquid movement equal to the inherent roll frequency of the ship. As apparent from comparisons made between the curves "A" through "E", the tank stabilizer according to the present invention comprising at least two tanks or two receptacles in one tank as in the foregoing is capable of producing substantially uniform stabilizing effects over wide ranges of higher and lower roll frequencies of the ship with respect to the inherent roll frequency of the ship. In FIG. 3, "Fo" indicates the inherent roll frequency of the ship.

Referring to FIGS. 4 and 5, the separation plate 10 vertically divides the crossover duct 6 into two parts at an imaginary longitudinal mid-line thereof, and also vertically divides the end chamber 2*a* at an imaginary diagonal line extending from the mid-point on the right edge line thereof to a corner point on the left edge line thereof, and further vertically divides the end chamber 2*b* at an imaginary diagonal line extending from the mid-point on the left edge line thereof to a corner point on the right edge line of the end chamber 2*b*. Thus, the duct 6 and the end chambers 2*a* and 2*b* are divided into two parts with a desired division ratio in terms of space volume so that the space volume of one resultant compartment is different from that of the other. It should be noted that two receptacles with desired space volumes for holding stabilizing liquid can also be obtained by dividing vertically the duct 6 in the longitudinal mid-line thereof, and by dividing the end chambers 2*a* and 2*b* with the tilted separation plate 10, as shown in FIG. 6.

Referring to FIG. 7, the duct 6 and the end chambers 2*a* and 2*b* are vertically divided into three parts with separation plates 10*a* and 10*b*, and the end chambers 2*a* and 2*b* are further vertically divided in diagonal lines with separation plates 10*c* and 10*d*. The resultant mid compartment has a natural frequency of stabilizing liquid movement equal to the inherent roll frequency of the ship. The resultant upper container has a higher natural frequency of stabilizing liquid with respect to the inherent roll frequency of the ship. The resultant lower receptacle has a lower natural frequency of stabilizing liquid with respect to the inherent roll frequency of the ship. The tank stabilizer shown in FIG. 7 is also capable of providing stabilizing effects over wide ranges of higher and lower roll frequencies of the ship with respect to the inherent roll frequency of the ship, as illustrated with the curve "A" in FIG. 3.

Figure 8:
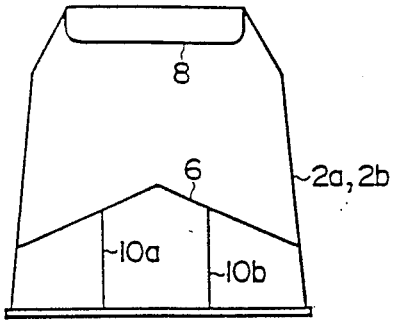
FIG. 8 shows a sectional side view of another embodiment according to the present invention.

Referring to FIG. 8, the duct 6 and the end chambers 2*a* and 2*b* are vertically divided by means of the separation plates 10*a* and 10*b* into three parts, each having the same dimensions on the bottom surface of the duct 6 and the end chambers 2*a* and 2*b*. The upper plane of the duct 6 is shaped as unequal angle planes so that three tubes having different opening dimensions are obtained. Thus, these three tubes have different natural frequencies of stabilizing liquid movement.

Figure 9:
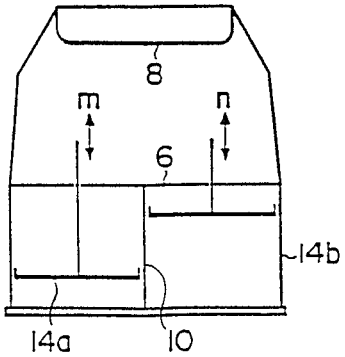
FIG. 9 shows a sectional side view of another embodiment according to the present invention.

Referring to FIG. 9, the duct 6 and the end chambers 2*a* and 2*b* are vertically divided by means of the separation plate 10 into two equal parts having the same dimensions on the bottom surfaces of the duct 6 and the end chambers 2*a* and 2*b* so that two U-tube containers are obtained. A horizontal plane 14*a*, which is vertically movable in the direction "m" is maintained in one resultant tube formed in the duct 6, and another horizontal plane 14*b*, which is also vertically movable in the direction "n" is maintained in the other tube formed in the duct 6. By appropriately adjusting the movable planes 14*a* and 14*b*, there can be provided two U-tube containers having different and desired opening dimensions, thus having desired natural frequencies of stabilizing liquid movement depending on the inherent roll frequency of a ship.

Figure 10:
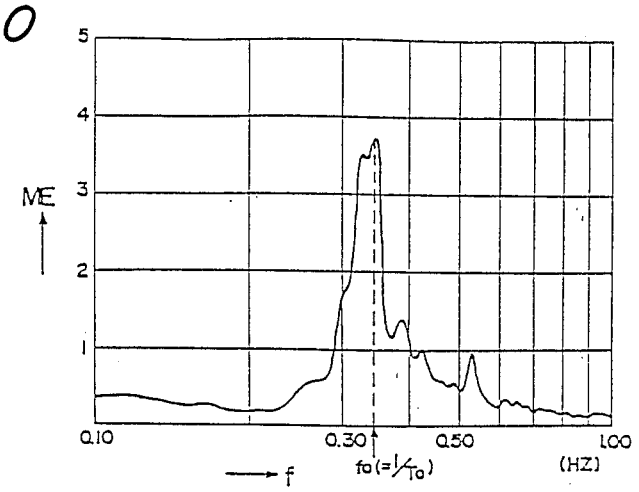
FIGS. 10 through 12 show characteristic diagrams obtained by experiment using tank stabilizers.
Figure 11:
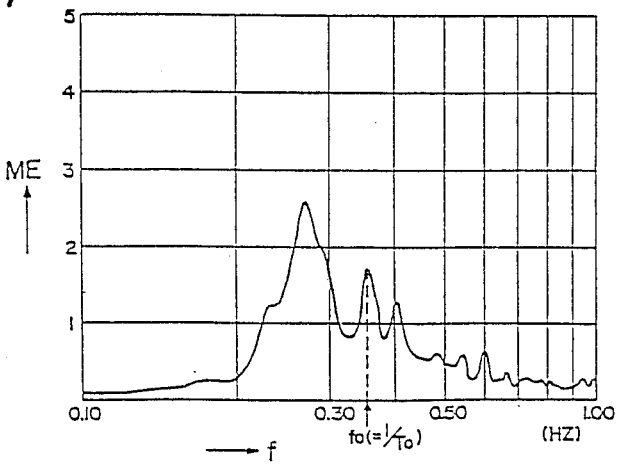
Figure 12:
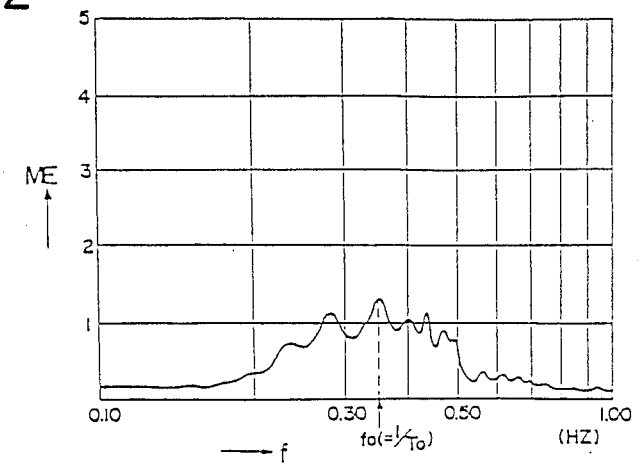
Figure 13:
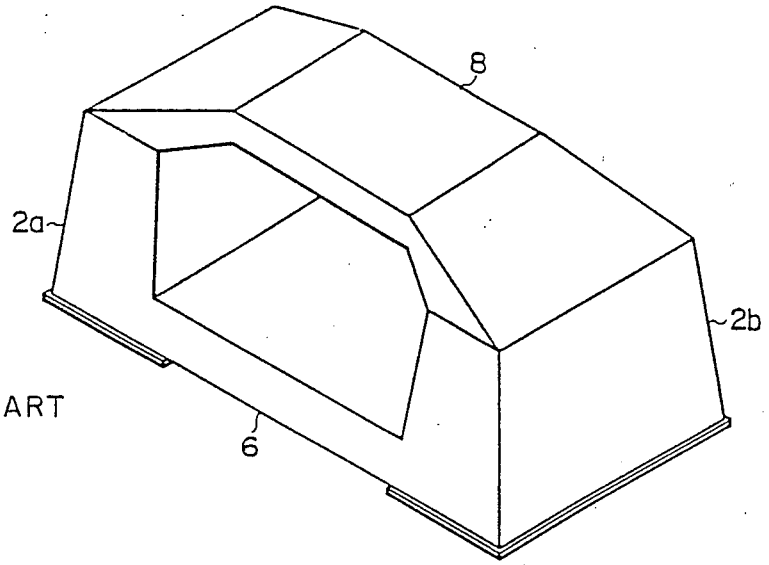
FIG. 13 shows a perspective view of a prior art tank stabilizer.
Figure 14:
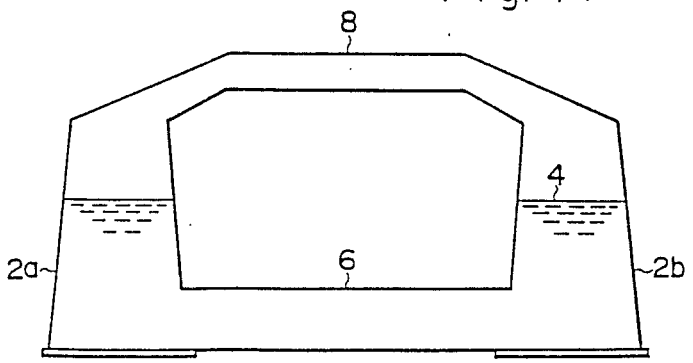
PRIOR ART Fig. 14
FIG. 14 shows a sectional front view of the tank stabilizer depicted in FIG. 13.
Figure 15:
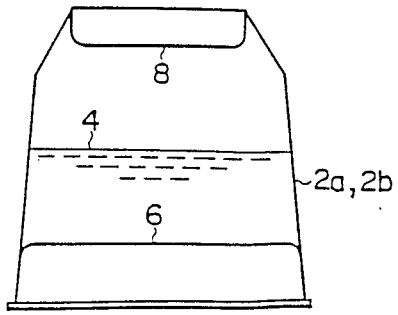
PRIOR ART FIG. 15
FIG. 15 shows a sectional side view of the tank stabilizer depicted in FIG. 13.

Hereinafter, there will be explained experimental results obtained by mounting a tank stabilizer according to the present invention on a vessel of nineteen gross ton, referring to FIGS. 10 through 12. In FIGS. 10 through 12, the horizontal axis represents the roll frequency "F" of a vessel, and the vertical axis represents roll energy "ME" of the vessel. The curve in FIG. 10 is obtained with the passive tank stabilizer, according to the present invention, in which no stabilizing liquid is placed therein. There will be generated roll movements which peak at the inherent roll frequency "Fo" of the ship and is in both higher and lower frequencies. The curve in FIG. 11 is obtained with the tank stabilizer, in which water of five hundred and five kilogram is filled to a level of 50 centimeter, and which has a higher natural frequency of stabilizing liquid movement with respect to the inherent roll frequency "Fo" of the ship, as with the prior art passive tank stabilizer explained in the foregoing. In this case, it is apparent from the curve that roll movement peaks in a lower roll frequency with respect to the inherent roll frequency "Fo", but stabilizing effects are obtained in higher roll frequencies with respect to the inherent roll frequency of the ship.

The curve of FIG. 12 is obtained with the passive tank stabilizer according to the present invention which has two tanks or two containers formed in one tank. One of the tanks or one container has a higher natural frequency of stabilizing liquid movement with respect to the inherent roll frequency of the ship, and the other tank or the other container has a lower natural frequency of stabilizing liquid movement with respect to the inherent roll frequency of the ship. It is apparent from the curve that stabilizing effects are produced in both lower and higher roll frequencies of the ship with respect to the inherent roll frequency of the ship. In this case, the water in the tank stabilizer is also filled to a level of fifty centimeters, in the same way as a prior art tank stabilizer the characteristic curve of which is shown in FIG. 11.

While, the invention has been described in detail and with reference to specific embodiments thereof, it will be apparent to one skilled in the art that various changes and modifications can be made therein without departing from the spirit and scope of invention.

What is claimed is:

1. A tank stabilizer mounted on a vessel comprising:
(i) a pair of end chambers which are capable of holding stabilizing liquid,
(ii) crossover duct interconnecting said end chambers near the lower portion thereof for transferring the stabilizing liquid between said end chambers, and
(iii) means for separating said end chambers and said crossover duct so that there are obtained two receptacles for holding the stabilizing liquid which are different in space volume from each other, with one receptacle having a higher natural frequency of stabilizing liquid movement with respect to the inherent roll frequency of the vessel and the other receptacle having a lower natural frequency of stabilizing liquid movement with respect to the inherent roll frequency of the vessel.

2. A tank stabilizer mounted on a vessel comprising:
(i) a pair of end chambers which are capable of holding stabilizing liquid,
(ii) crossover duct interconncting said end chambers near the lower portion thereof for transferring the stabilizing liquid between said end chambers, and
(iii) means for separating said end chambers and said crossover duct so that there are obtained three receptacles for holding the stabilizing liquid which are different in space volume from one another, with one receptacle having a higher natural frequency of stabilizing liquid movement with respect to the inherent roll frequency of the vessel, and another receptacle having a lower natural frequency of stabilizing liquid movement with respect to the inherent roll frequency of the vessel and the other receptacle having substantially the same natural frequency of stabilizing liquid movement as the inherent roll frequency of the vessel.

3. A tank stabilizer mounted on a vessel comprising:
(i) first tank comprising a pair of first end chambers and first crossover duct interconnecting said first end chambers near the lower portion thereof, and containing stabilizing liquid therein, with the natural frequency of stabilizing liquid movement in the first tank being higher with respect to the roll frequency of the vessel, and
(ii) second tank comprising a pair of second end chambers and second crossover duct interconnecting said second end chambers near the lower portion thereof, containing stabilizing liquid therein, with the natural frequency of stabilizing liquid movement in the second tank being lower with respect ot the roll frequency of the vessel, and being disposed in parallel with said first tank.

4. A tank stabilizer mounted on a vessel comprising:
(i) first tank comprising a pair of first end chambers and first crossover duct interconnecting said first end chambers near the lower portion thereof, and containing stabilizing liquid therein, with the natural frequency of stabilizing liquid movement in the first tank being higher with respect to the roll frequency of the vessel,
(ii) second tank comprising a pair of second end chambers and second crossover duct interconnecting said second end chambers near the lower portion thereof, containing stabilizing liquid therein, with the natural frequency of stabilizing liquid movement in the second tank being lower with respect to the roll frequency of the vessel, and being disposed in parallel with said first tank, and
(iii) third tank comprising a pair of third end chambers and third crossover duct interconnecting said third end chambers near the lower portion thereof, containing stabilizing liquid therein, with the natural frequency of stabilizing liquid movement in the third tank being substantially the same as the roll frequency of the vessel, and being disposed in parallel with said first tank.

5. The tank stabilizer as defined in claim 1 further comprises means for varying the sectional dimension of each resultant tube portion of the two receptacles.

6. The tank stabilizer as defined in claim 2 further comprises means for varying the sectional dimension of each resultant tube portion of the three receptacles.

7. The tank stabilizer as defined in claim 3 further comprises means for varying the sectional dimensions of the first and second crossover ducts.

8. The tank stabilizer as defined in claim 4 further comprises means for varying the sectional dimensions of the first, second and third crossover ducts.

* * * * *